United States Patent [19]

Meyer

[11] Patent Number: 4,737,083

[45] Date of Patent: Apr. 12, 1988

[54] DIAPHRAGM PUMP WITH AN ELASTIC FILTER DISK

[76] Inventor: Hans Meyer, 24, rue du Bugnon, 1020 Renens, Switzerland

[21] Appl. No.: 937,714

[22] Filed: Dec. 4, 1986

[51] Int. Cl.[4] ..... F04B 43/00

[52] U.S. Cl. ..... 417/413; 417/480; 417/566; 55/385 R; 55/438

[58] Field of Search ..... 417/413, 274, 313, 480, 417/510, 566; 92/60.5; 55/385 R, 438; 74/18.2

[56] References Cited

U.S. PATENT DOCUMENTS

| | | | |
|---|---|---|---|
| 2,144,662 | 1/1939 | Paasche | 417/413 X |
| 2,529,204 | 11/1950 | Van Ranst et al. | 417/566 X |
| 2,961,149 | 11/1960 | Hull | 417/566 X |
| 3,198,421 | 8/1965 | Alyea et al. | 92/60.5 |
| 4,103,590 | 8/1978 | Putt | 55/385 R X |
| 4,181,477 | 1/1980 | Litt | 417/566 X |
| 4,482,301 | 11/1984 | Schlick | 417/413 X |
| 4,545,735 | 10/1985 | Ims | 417/413 X |
| 4,594,058 | 1/1986 | Fischell | 417/413 |

*Primary Examiner*—Leonard E. Smith
*Assistant Examiner*—Szczecina, Jr. Eugene L.
*Attorney, Agent, or Firm*—Gifford, Groh, VanOphem, Sheridan, Sprinkle and Dolgorukov

[57] ABSTRACT

A pump having a pump body (1), a push-rod (7), a diaphragm (8) with an aperture (17) and a plate valve (9). The push-rod (7) is driven by a motor (10) and is guided centrally in an elastic filter disk (13) mounted in a pump casing (3). A lower end of the push-rod (7) is provided with a dome (12) member by which the diaphragm (8) is pressed into a correspondingly shaped recess (15).

6 Claims, 1 Drawing Sheet

DIAPHRAGM PUMP WITH AN ELASTIC FILTER DISK

BACKGROUND OF THE INVENTION

Field of the Invention

The invention concerns a pump consisting of a casing, inside which is a reciprocating push-rod moved to and fro by a drive system, a diaphragm and an outlet valve.

DESCRIPTION OF THE INVENTION

It is known that diaphragm pumps exist which comprise a push-rod, a diaphragm that operates in conjunction with the latter, as well as inlet and outlet valves. In the case of small pumps, the valves are mainly of the flap type, which operate perfectly at the usual stroke frequencies (a thousand per minute). If, however, for technical reasons the stroke frequency has to be reduced (for example to several hundred strokes per minute), flap valves—especially at low pump pressures—present the disadvantage that they no longer provide a perfect seal.

SUMMARY OF THE INVENTION

The purpose of the invention is to produce a diaphragm pump which operates perfectly even at low stroke frequencies and is of the simplest possible design.

The problem is solved in the invention by the fact that the pushrod possesses, at its end opposite to the diaphragm, a pressure surface by means of which the diaphragm is pressed into a recess in the casing, and by the fact that the diaphragm possesses at least one opening which is periodically closed by the push-rod, the recess being arranged to communicate with the outlet valve.

The pump as described in the invention offers the advantage that the diaphragm exercises at the same time the function of a valve, as a result of which there is a saving of one valve; in addition, the pump operates perfectly at low stroke frequencies and at the same time the design is simplified.

A preferred embodiment is characterized by the fact that it possesses a flexible disc by which the push-rod is maintained and guided centrally in the casing. This disc consists preferably of a filter material, which offers the advantage that the disc at the same time serves as a supporting, centering and filtering element.

In one embodiment, the casing consists of at least three casing parts arranged one over the other, the flexible disc and the diaphragm each being gripped between two of these casing elements, and this considerably simplifies the design.

In the ensuing description an example is given of the operation of the pump forming the object of the invention and a variant.

DESCRIPTION OF THE PREFERRED EMBODIMENT

Figure 1:
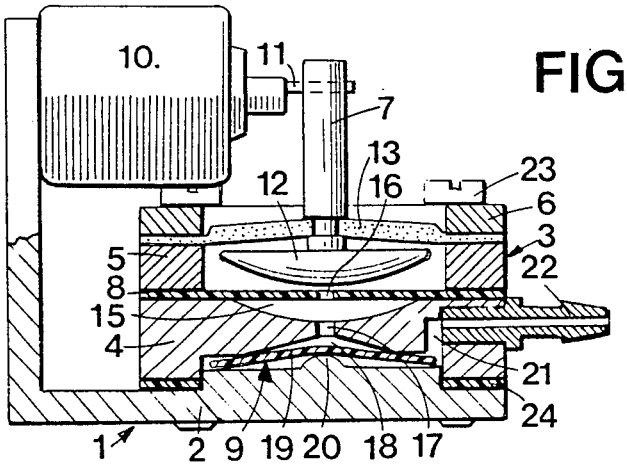
FIG. 1 illustrates the pump, represented in cross-section.

The pump in accordance with FIG. 1 possesses a pump body (1) with a base element (2) and with a casing (3) consisting of three superimposed casing parts (4, 5 and 6). The pump consists, furthermore, of a push-rod (7), a diaphragm (8) and an outlet valve (9). The push-rod (7) is moved up and down by a motor (10) via an eccentric (11). This type of drive method was chosen on grounds of simplicity. The push-rod (7) can be guided axially in a suitable bearing in order to avoid lateral vibrations. At the end facing the diaphragm (8), the push-rod (7) has a pressure application surface in the form of a spherical dome (12) and is guided centrally in the pump casing (20) by an elastic disc (13). The disc (13) serves at the same time as a filter for the pump medium: in the present case, the pump is envisaged for the conveyance of air. It is advantageous that the disc (13) is made from a suitable rubber sponge material.

The pump push-rod (7) is shown in FIG. 1 in its upper operating position. During descent, it presses the elastic diaphragm (8) into a recess in the form of a dome-shaped depression (15) in the lower part of the casing (4) and thereby closed the aperture (16) in the diaphragm (8). As a result, the air is driven through the opening (17) in the operating chamber (18) of the outlet valve (9). This consists of a plate valve with an elastic plate (19) which is slightly pre-tensioned by a projection in the base element (1). After passing through this plate valve (9) the air flows out through the passage (21) and through the nipple (22). On the upward return stroke of the push-rod (7), the plate valve (9) closes the opening (17). An under-pressure is thereby produced in the opening chamber (18) by which the diaphragm (8) is held back for a time long enough for the aperture (16) to be cleared and thus the new air can flow in through the filter disc (13).

Instead of the plate valve shown in FIG. 1, another type of valve can also be used, for example a spherical valve.

The pump body composed of the base element (2), the casing elements (4, 5 and 6) is held together by four screws (23). The filter disc (13) is in this case tensioned between the parts (5) and (6) and the diaphragm between parts (4) and (5). The base element (2) is sealed against the part (4) by a seal (24). The drive motor (10) is secured to the base element (2).

Figure 2:
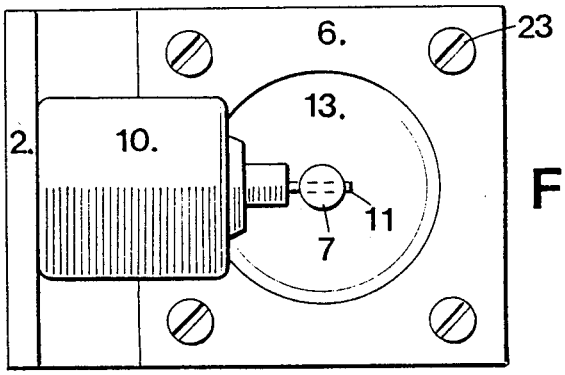
FIG. 2 illustrates a view from above of FIG. 1.
Figure 3:
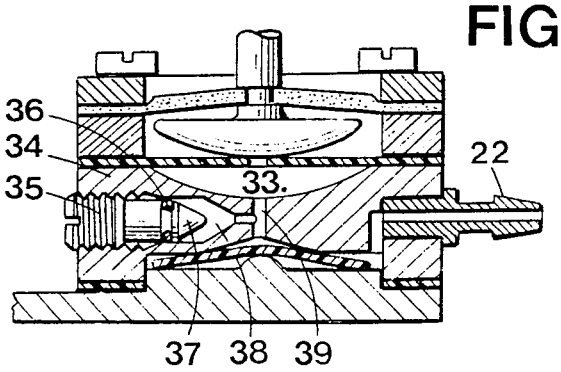
FIG. 3 illustrates a variant of the pump with a built-in pressure regulator.

The variant which is illustrated in FIG. 3 possesses in principle the same design as in FIGS. 1 and 2. Here, the pump is fitted in addition with a pressure regulator, consisting of an adjuster screw (35), which is sealed against the casing (34) by means of a seal (36) and when the screw taper (37) is unscrewed, a cavity (38) is produced. Since this cavity (38) is connected by the passage (39) to the pump chamber (33), a variation in the pump pressure can be obtained by modifying this cavity (38). This arrangement can offer advantages if an over-pressure valve of a known design is not desired because moving parts are used in it. The type of valve shown operates in a purely static manner and is therefore more reliable in operation.

I claim:

1. A pump for pumping fluid, said pump driven by a motor having an eccentric member, said pump comprising:

a pump body having an outlet valve and a casing, said casing having a surface having a concave recess and an opening for fluid communication between said recess and said outlet valve, said casing having an opening defining an intake;

a flexible diaphragm mounted to the pump body adjacent said recess, said diaphragm having an aperture, said diaphragm movable to and away from said recess;

a pushrod having one end rotatably mounted to said motor for axial movement with respect to said casing, said push rod having an opposite end having a dome-shaped pressure applicator adapted to be received within said recess, said pressure applicator periodically contacting said diaphragm to direct said diaphragm towards and away from said recess for pumping fluid through said opening of said surface and through said outlet valve; and an elastic disc affixed to said casing, said elastic disc having a central aperture adapted to receive said pushrod, said elastic disc resiliently supporting said pushrod centrally within said casing, said elastic disc formed of a porous filter material whereby said fluid to be pumped is filtered.

2. The pump as claimed in claim 1, wherein said diaphragm further comprises said aperture being disposed centrally in said diaphragm co-axial with said opening of said surface.

3. The pump as claimed in claim 1 wherein said outlet valve further comprises:

a dome-shaped depression opposite said surface of said casing; and a pretensioned elastic member movable to and away from said dome-shaped depression to sealingly close said opening of said casing when said pressure applicator surface moves away from said recess.

4. The pump as claimed in claim 1, further comprising;

a pump chamber in flow communication with said opening disposed between said diaphragm and said outlet valve; and means for regulating the pressure of said pump chamber by varying the size of the pump chamber.

5. The pump as claimed in claim 4, wherein said means for regulating the pressure comprises an adjuster screw threadably mounted in a cavity of casing, said cavity communicating with said opening in said casing, said screw movable in said cavity to vary the pump pressure.

6. The pump as claimed in claim 1, wherein said casing further comprises at least three superimposed members, said elastic disc and said diaphragm each disposed in a spaced apart relationship between two of said at least three superimposed members.

* * * * *